US010593140B2

(12) United States Patent
Razzoli

(10) Patent No.: US 10,593,140 B2
(45) Date of Patent: Mar. 17, 2020

(54) SMART LOCKER SYSTEM AND METHODS FOR USE THEREOF

(71) Applicants: Michael Robert Razzoli, Anaheim, CA (US); Donna Sara Razzoli, Anaheim, CA (US)

(72) Inventor: Michael Robert Razzoli, Anaheim, CA (US)

(73) Assignees: Michael Robert Razzoli, Anaheim, CA (US); Donna Sara Razzoli, Anaheim, CA (US)

( * ) Notice: Subject to any disclaimer, the term of this patent is extended or adjusted under 35 U.S.C. 154(b) by 0 days.

(21) Appl. No.: 16/234,398

(22) Filed: Dec. 27, 2018

(65) Prior Publication Data

US 2019/0197809 A1 Jun. 27, 2019

Related U.S. Application Data

(60) Provisional application No. 62/610,754, filed on Dec. 27, 2017, provisional application No. 62/610,799, filed on Dec. 27, 2017, provisional application No. 62/638,712, filed on Mar. 5, 2018.

(51) Int. Cl.
*G07C 9/00* (2020.01)

(52) U.S. Cl.
CPC ..... *G07C 9/00912* (2013.01); *G07C 9/00166* (2013.01); *G07C 9/00571* (2013.01); *G07C 9/00896* (2013.01)

(58) Field of Classification Search
CPC ..... A01D 34/00; G08B 13/14; G08B 13/18; G08B 13/24; G08B 13/183; G01S 13/56; G06F 3/044
USPC ..... 340/5.73
See application file for complete search history.

(56) References Cited

U.S. PATENT DOCUMENTS 4,633,236 A * 12/1986 Buhl ..... A47G 29/1212 232/37
6,433,684 B1 * 8/2002 Lie ..... A47G 29/1214 340/545.6
6,462,659 B1 * 10/2002 Schuette ..... A47G 29/1214 340/569
6,789,585 B1 * 9/2004 Janke ..... F25D 23/126 141/198
7,187,285 B2 * 3/2007 Staples ..... A47G 29/1214 200/61.63

(Continued)

*Primary Examiner* — Nam V Nguyen
(74) *Attorney, Agent, or Firm* — Michael D. Eisenberg

(57) ABSTRACT

A system of lockers includes at least two groups of lockers, a control unit, a user interface, a communication unit. Each group of lockers has lockers designated for a respective parcel type. The control unit communicates with the lockers and is configured to control an opening of each locker. The user interface is configured to receive from a delivery person input indicative an identification of the delivery person. The communication unit is configured to communicate the input from the user interface to a data center. The data center is configured to store a plurality of identifications of a plurality of delivery persons associated with one or more of the lockers, for comparing the input with the plurality of identifications, and for transmitting to the control unit a command to open one or more of the lockers associated with the identification input by the delivery person.

4 Claims, 14 Drawing Sheets

(56) References Cited

U.S. PATENT DOCUMENTS

| | | | | |
|---|---|---|---|---|
| 7,412,330 | B2 * | 8/2008 | Spicer | G01B 11/24 702/2 |
| 7,525,429 | B2 * | 4/2009 | Carrigan | A47G 29/1201 340/505 |
| 8,353,321 | B2 * | 1/2013 | Agam | B67D 1/124 141/198 |
| 10,055,959 | B1 * | 8/2018 | Russell | G01S 13/0209 |
| 2002/0178074 | A1 * | 11/2002 | Bloom | G06Q 10/08 705/26.81 |
| 2008/0094624 | A1 * | 4/2008 | Harsh | G01J 3/02 356/311 |
| 2011/0006897 | A1 * | 1/2011 | Micko | G08B 13/191 340/565 |
| 2016/0342943 | A1 * | 11/2016 | Wiechers | G06Q 10/0833 |
| 2017/0105595 | A1 * | 4/2017 | Lambert | G06F 3/14 |

* cited by examiner

SMART LOCKER SYSTEM AND METHODS FOR USE THEREOF

CROSS-REFERENCES TO RELATED APPLICATIONS

The present application claims priority from U.S. Provisional Patent Application Ser. No. 62/610,754 filed on Dec. 27, 2017, U.S. Provisional Patent Application Ser. No. 62/610,799 filed on Dec. 27, 2017, and U.S. Provisional Patent Application Ser. No. 62/638,712 filed on Mar. 5, 2018, which are all hereby incorporated herein by reference in its entirety.

TECHNICAL FIELD

The present invention relates smart lockers or intelligent lockers for delivery and pickup of parcels.

BACKGROUND OF THE INVENTION

Today's smart lockers are designed horizontally where any package or envelope sits on the ground of the locker regardless of the size or the thickness of the delivered package, parcel, or envelope.

Some lockers are equipped with sensors configured for detecting the presence of any package having a thickness larger than ¼ inch. Data about the presence or absence of a package in a smart locker from the sensors enables control the smart locker's workflow fully automatically. For example, once the presence of the data is detected, a control unit associated with the smart locker automatically sends the recipient of the package a message to inform the recipient that the package is waiting to be picked up at the smart locker, with information on how to retrieve the package.

However, if the thickness of the delivered package is less than ¼ inch, which is the case for most flats and envelopes, the sensors are not able to detect these thin packages and thus cannot determine the existence of these types of package in the locker. As a result of this issue, control unit cannot rely on the sensors to generate accurate information regarding the existence of a package in a smart locker regardless of the size or thickness of the package, because a delivery person may choose to deliver a thin package or a flat to any locker. Therefore, if a package or flat isn't detected by the sensors, the control unit relies on the delivery person to indicate if he/she has in fact delivered a package or not. If the delivery person inputs the wrong message into the smart locker's user interface, the control unit's workflow—which includes data recording and notification to the recipients—may generate undesired results, such as the "Empty Locker" or "Ghost Delivery" errors.

An "Empty Locker" error happens if the delivery person indicates a delivery even when he/she didn't deposit a package inside the smart locker. In this case the control unit records a delivery, generates a pickup code and sends an email or text notification to the recipient that contains the pickup code. The recipient of this pickup code will find a locker that is empty, which leads to confusion and most likely a support call to the support department. A "Ghost Delivery" error happens when the delivery person selects "No Delivery" even though he/she has delivered a thin package to the smart locker. In this case, the control does not record a delivery, the locker is not be marked as occupied, no pickup code is generated, and no notification is sent out to the recipient. This leads to a package delivered to a locker but there is no record of it and nobody knows anything about it.

Likewise, today's dry cleaning lockers do not have a sensors and thus the application workflow cannot rely on the sensors to indicate whether a package is delivered or not and whether a package have been picked up after the smart locker's door has been opened. Therefore, a wrong input by the delivery person into the dry cleaning locker causes the "Empty Locker" error or "Ghost Delivery" error.

BRIEF SUMMARY OF EMBODIMENTS OF THE INVENTION

Therefore, an aspect of some embodiments of the present invention relates to a locker for storage of a parcel, the locker comprising: i) a front side with a vertical height and horizontal width, the vertical height being larger than the horizontal width; ii) a first and second side wall, each having the vertical height and a horizontal depth; and iii) a sensor system. The sensor system includes an array of emitter, an array of receivers, and a controller. The array of emitters is located at the first side wall, each emitter being configured for emitting a respective electromagnetic wave. The array of receivers is located at the second side wall, each receiver being configured for detecting the electromagnetic waves from one or more of the emitters, each receiver being configured for generating signals indicative of detection and lack of detection of the electromagnetic waves, The controller is configured for receiving the signals from the emitters and processing the signals to determine a presence or absence of the parcel in the locker. A parcel located in the locker blocks a propagation of at least some of the electromagnetic waves toward the emitters.

In a variant, the emitters are embedded in the first side wall and the receivers are embedded in the second side wall.

In another variant, the first and second walls have respectively first and second recesses, the recesses being level with a floor of the locker and parallel to a floor of the locker. The emitters are arranged horizontally and located in the first recess. The receivers are arranged horizontally and located in the second recess.

In yet another variant, the emitters are arranged horizontally and located in the first recess, such that a first empty space is present between the floor and the array of emitters. The receivers are arranged horizontally and located in the second recess, such that a second empty space is present between the floor and the array of receivers.

In a further variant, the emitters are arranged horizontally on the first wall and the receivers are arranged horizontally on the second wall.

In yet a further variant, the emitters are arranged diagonally on the first wall and the receivers are arranged diagonally on the second wall.

In a variant, the emitters are arranged on a first cross pattern on the first wall and the receivers are arranged on a second cross pattern on the second wall.

In another variant the vertical height and horizontal width have respective sizes configured for ensuring that a flat parcel inserted into the locker does cannot lie flat on a floor of the locker and is supported by at least one of the first and second walls.

Another aspect of some embodiments of the present invention relates to a locker for storage of a parcel. The locker includes i) a floor, a ceiling, a first side wall, and second side wall and ii) a sensor system. The sensor system includes an array of emitters, an array of receivers, and a controller. The array of emitters is located at the floor or the ceiling, each emitter being configured for emitting a respective electromagnetic wave into a volume of the locker. The array of receivers is located at one of the floor or the ceiling, opposite the array of emitters, each receiver being configured for detecting the electromagnetic waves from one or more of the emitters, each receiver being configured for generating signals indicative of detection or lack of detection of the electromagnetic waves. The controller is configured for receiving the signals from the emitters and processing the signals to determine a presence or absence of the parcel in the locker. A parcel located in the locker blocks a propagation of at least some of the electromagnetic waves toward the emitters.

In a variant, the sensor system is embedded in the floor and ceiling.

In another variant, the emitters are arranged diagonally, and the receivers are arranged diagonally.

In yet another variant, the emitters are arranged in a first cross pattern, and the receivers are arranged in a second cross pattern.

A further aspect of some embodiments of the present invention relates to a system of lockers comprising at least two groups of lockers, a control unit, a user interface, a communication unit. Each group of lockers has lockers designated for a respective parcel type. The control unit communicates with the lockers and is configured to control an opening of each locker. The user interface is configured to receive from a delivery person input indicative an identification of the delivery person. The communication unit is configured to communicate the input from the user interface to a data center. The data center is configured to store a plurality of identifications of a plurality of delivery persons associated with one or more of the lockers, for comparing the input with the plurality of identifications, and for transmitting to the control unit a command to open one or more of the lockers associated with the identification input by the delivery person.

In a variant, a first group of the lockers is designated for receiving mass mail. Postal workers are associated with all the lockers belonging to the first group. Upon receiving the input indicative of the identification of a postal worker, the data center is configured for sending a first command to the control unit to open all lockers of the first group, to enable the postal worker to deliver all the mass mail to all the lockers of the first group.

In another variant, a second group of lockers is designated for receiving parcels that are not mass mail. Parcel delivery persons are associated with lockers belonging to the second group. Upon receiving the input indicative of the identification of a parcel delivery person, the data center is configured for sending a second command to the user interface to prompt the parcel delivery person to input a size of the parcel. Upon receiving the size of the parcel, the control unit is configured for opening one of the lockers of the second group that correspond to the size of the parcel.

In yet another variant, each locker of the first group is associated with a respective recipient. Each locker of the first group comprises a respective sensing system configured for sensing presence and/or absence of mail inside the lockers. The control unit comprises a processing unit and a memory unit, the processing unit being configured for receiving at time points separated by a predetermined interval data indicative of the presence or absence of mail in the lockers of the first group from each sensing system, for storing the data, and for comparing the data to corresponding data recorded at a preceding time point to identify one or more lockers that were empty at the preceding time point that contain mail at the current time point. The data center is configured for storing contact information of the recipients associated with the lockers of the first group, for receiving a list of the one or more identified lockers, and for contacting each of one or more recipients associated with the one or more identified lockers to inform each the one or more recipients that new mail has been delivered to respective locker.

In a further variant, the data center is located remotely from the lockers.

In yet a further variant, the system includes the data center.

BRIEF DESCRIPTION OF DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Figure 1:
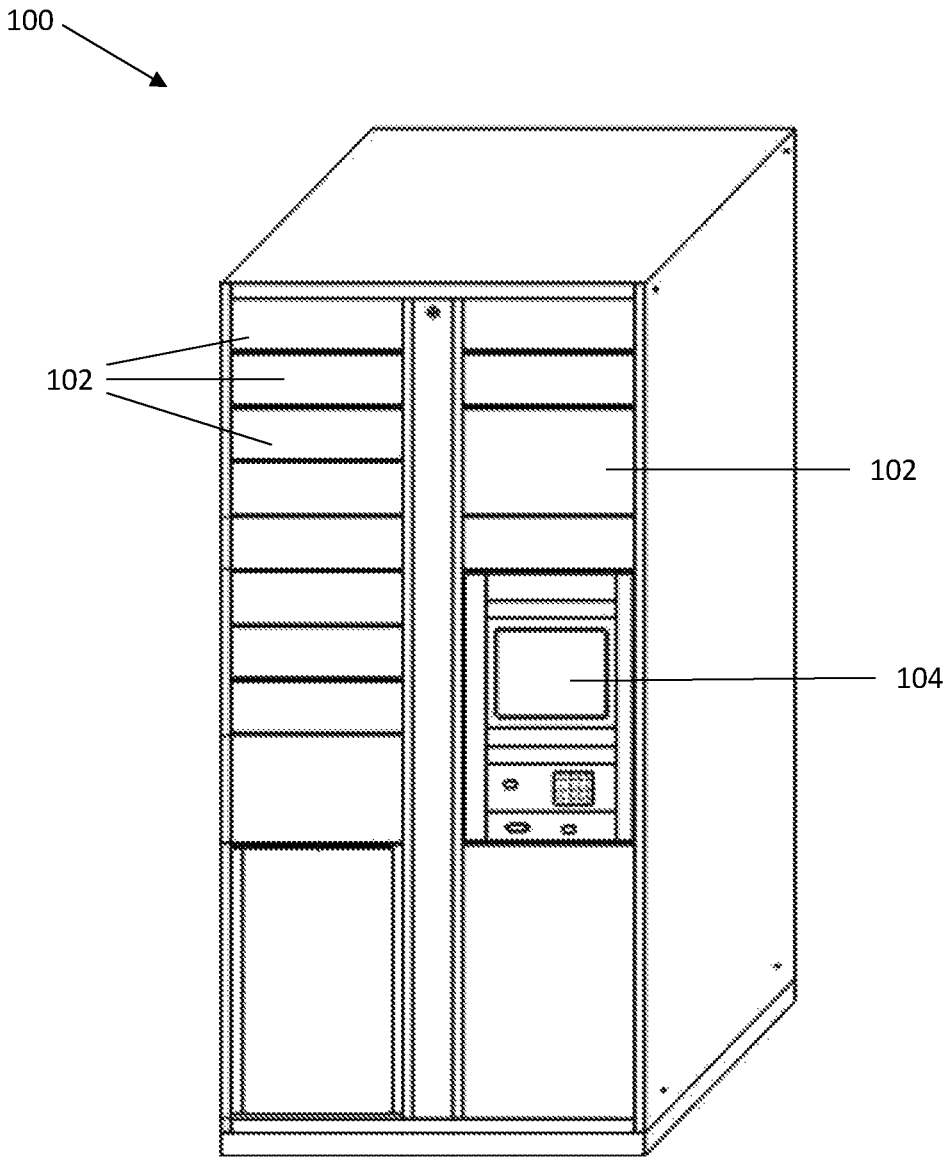
Fig. 1 (Prior Art)
FIG. 1 is a smart locker system, as known in the prior art.

Referring now to the figure, FIG. 1 is a smart locker system 100, as known in the prior art.

The system 100 includes a plurality of smart locker 102 and a user interface 104 configured for enabling a user (delivery person or recipient) to provide an input to the system 100. The system 100 also includes a control unit (not shown) configured for operating (opening) one or more smart lockers 102 if the user input is correct.

Figure 2:
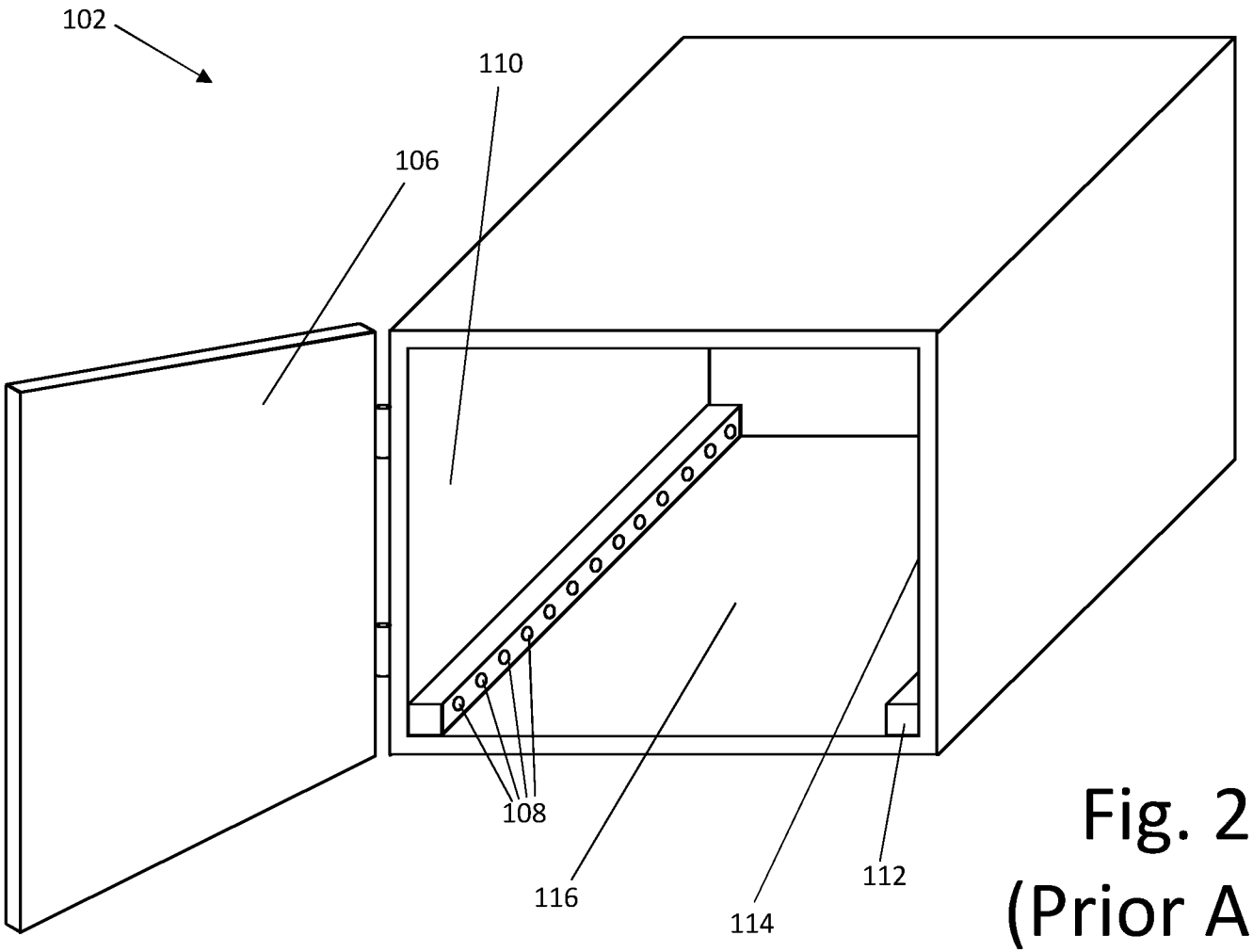
Fig. 2 (Prior Art)
FIG. 2 is a perspective view of an open smart locker, as known in the prior art.

FIG. 2 is a perspective view of an open smart locker, as known in the prior art.

In the prior art, the smart locker 102 is a box having a door 106 at the front, and having a sensor system within. The sensor system includes an array of emitters 108 extending horizontally along a first side wall 110 and an array of receivers 112 extending horizontally along a second side wall 114. The emitters 108 are generally placed inside a sheath having a plurality of holes aligned with the emitters. The emitters may be inside the sheath or may partially protrude from the holes. The sheath is located at the bottom of the first wall and protrudes along the floor 116 toward the second wall. Likewise, the receivers 114 are generally located in a second sheath having a plurality of second holes aligned with the receivers. The receivers may be inside the second sheath or may partially protrude from the second holes. The second sheath is located at the bottom of the second wall and protrudes along the floor 116 toward the first wall.

Each emitter 108 is configured to emit a respective electromagnetic wave (which may include any of visible light and infrared light) toward the receivers. The receivers 112 are configured for detecting the electromagnetic waves emitted by the respective emitter.

Figure 3:
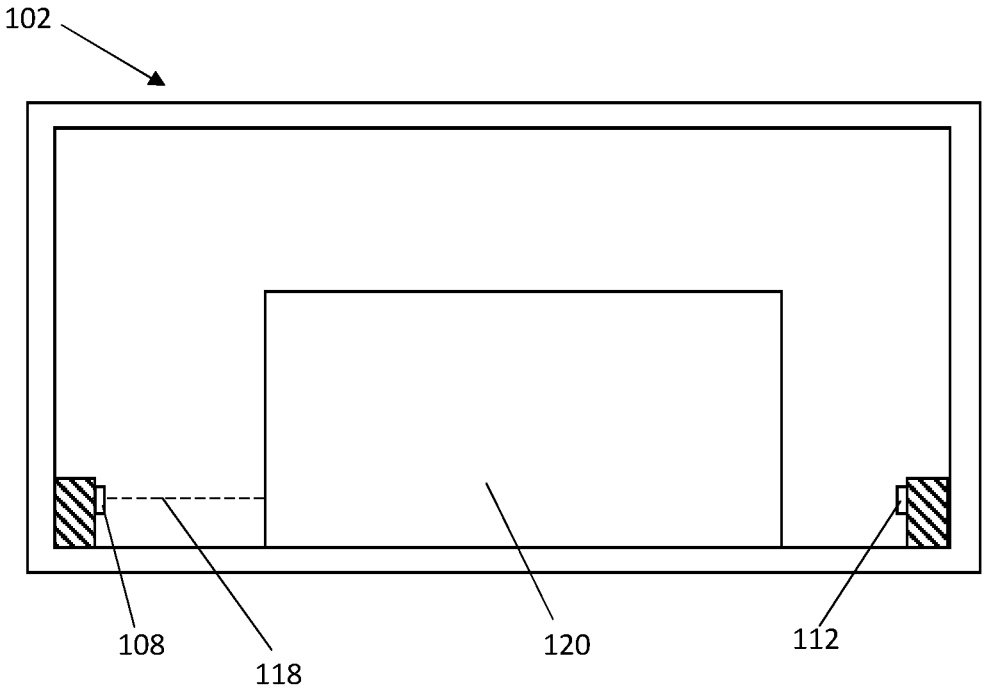
Fig. 3 (Prior Art)
FIG. 3 is a cross sectional front view of a smart locker containing a parcel, as known in the prior art.

FIG. 3 is a cross sectional front view of the smart locker 102 containing a parcel 120, as known in the prior art.

If a parcel 120 is tall enough, the parcel 120 absorbs and/or reflects the electromagnetic waves 118 emitted by the emitters 108, preventing the electromagnetic waves from propagating toward at least some of the receivers 112. If at least some of the receivers 112 do not detect the emitted electromagnetic waves 108, a control unit associated with the smart locker 102 designates the locker 102 full.

Figure 4A:
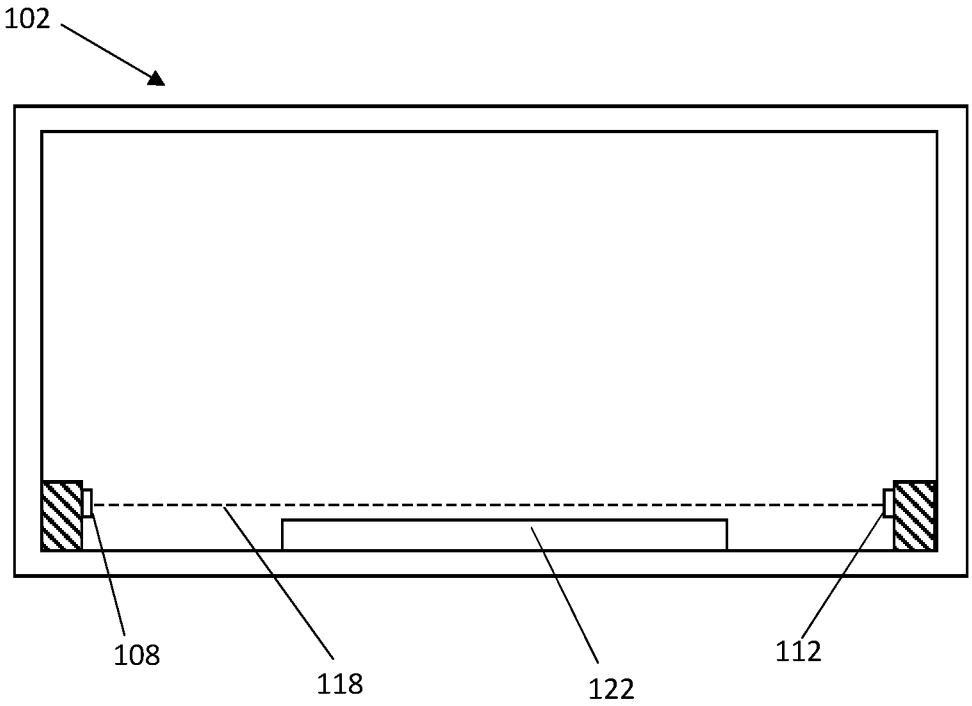
Fig. 4a (Prior Art)
FIG. 4*a* is a cross sectional front view of a smart locker containing a flat parcel, as known in the prior art.

FIG. 4*a* is a cross sectional front view of the smart locker 102 containing a flat parcel 122, as known in the prior art.

The emitters 108 and receivers 112 are generally placed at a certain distance from the floor of the locker 102. Therefore, a flat parcel 122 laying flat on the floor of the locker 102 may not be thick enough to prevent the electromagnetic wave 118 from being detected by the receiver 112. Thus, a control unit in communication with the receivers may designate the locker to be empty, even if a flat parcel 122 is in the locker 102.

Figure 4B:
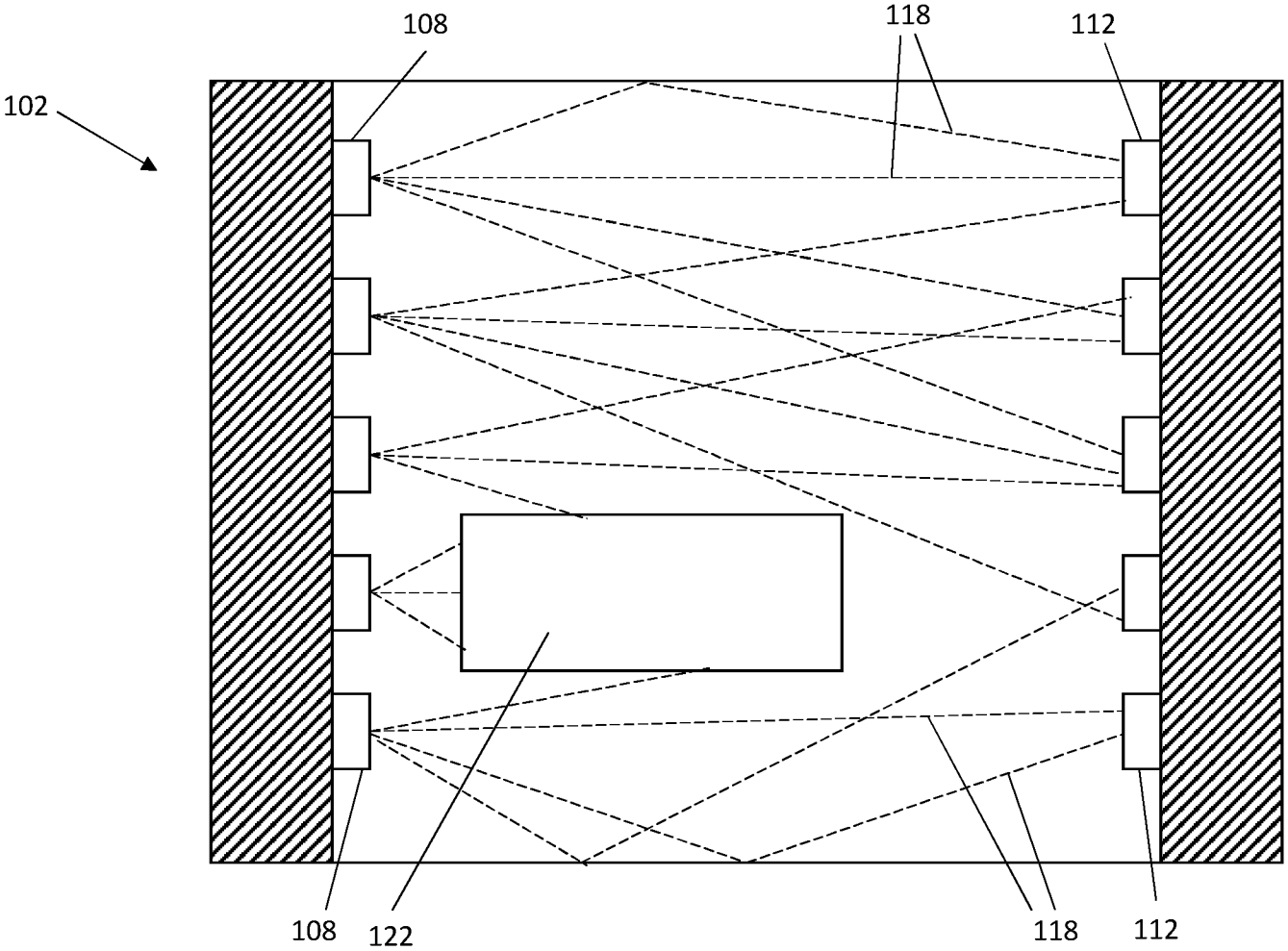
Fig. 4b (Prior Art)
FIG. 4*b* is a cross sectional top view of the smart locker containing a flat parcel, as known in the prior art.

FIG. 4*b* is a cross sectional top view of the smart locker 102 containing a flat parcel 122, as known in the prior art.

It can be seen that each emitter 108 emits an electromagnetic wave in the form of a flood of waves propagating in different directions. Therefore, waves from any emitter may be detected by a plurality of receivers 112. Because in the prior art the distance between the side walls of the locker 102 is substantially larger than the width of a flat parcel, there is enough space for the electromagnetic waves 118 to reach the all the receivers, even if the distance flat parcel 122 does block the propagation of some of the waves.

Figure 5:
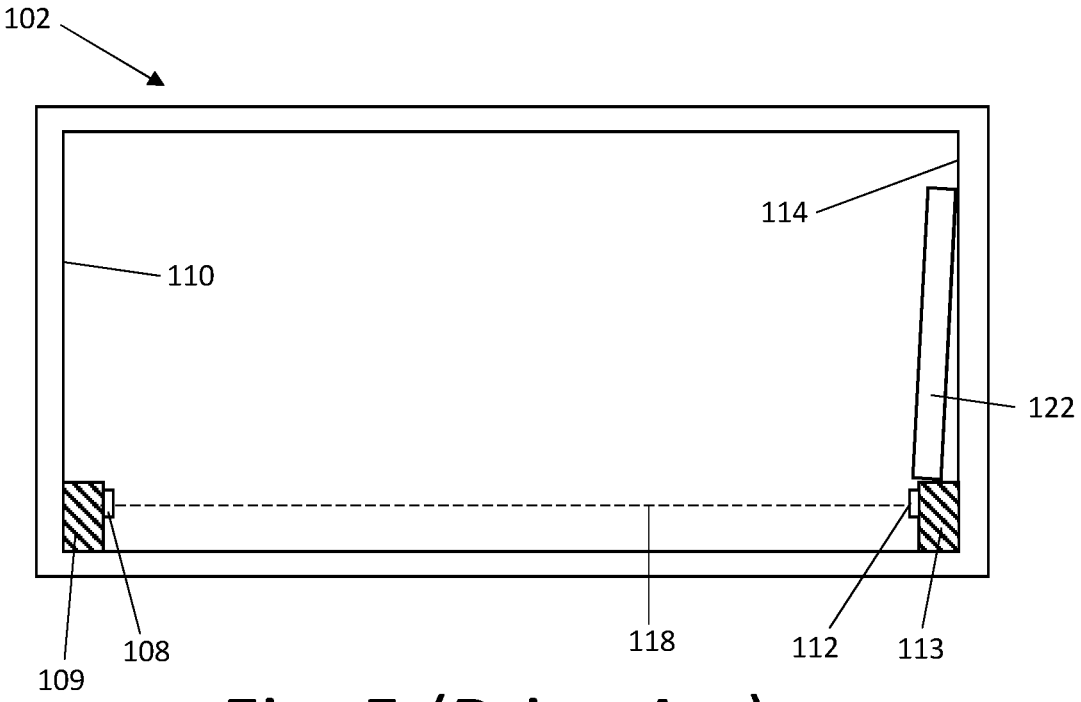
Fig. 5 (Prior Art)
FIG. 5 is a cross sectional front view of a smart locker containing a flat parcel, in which the parcel stands on a receiver of the smart locker's sensor system, as known in the prior art.

FIG. 5 is a cross sectional front view of a smart locker containing a flat parcel, in which the parcel stands on a receiver of the smart locker's sensor system, as known in the prior art.

Another problem with the smart locker 102 of the prior art is that the first sheath 109 containing the emitters 108 and the second sheath 113 containing the receivers 112 extend away from the respective sidewalls along the floor of the smart locker 102. Therefore, a flat parcel 122 may be placed in the smart locker 102 to stand on the top face of the first sheath 109 and lean against the first side wall 110 or to stand on the top face of the second sheath 113 and lean against the second side wall 114. In this manner the flat parcel 122 does not interrupt the propagation of the electromagnetic wave 118 from the emitter 108 to the receiver 112 and is the presence of the flat parcel 122 is not detected by the sensor system.

Figure 6A:
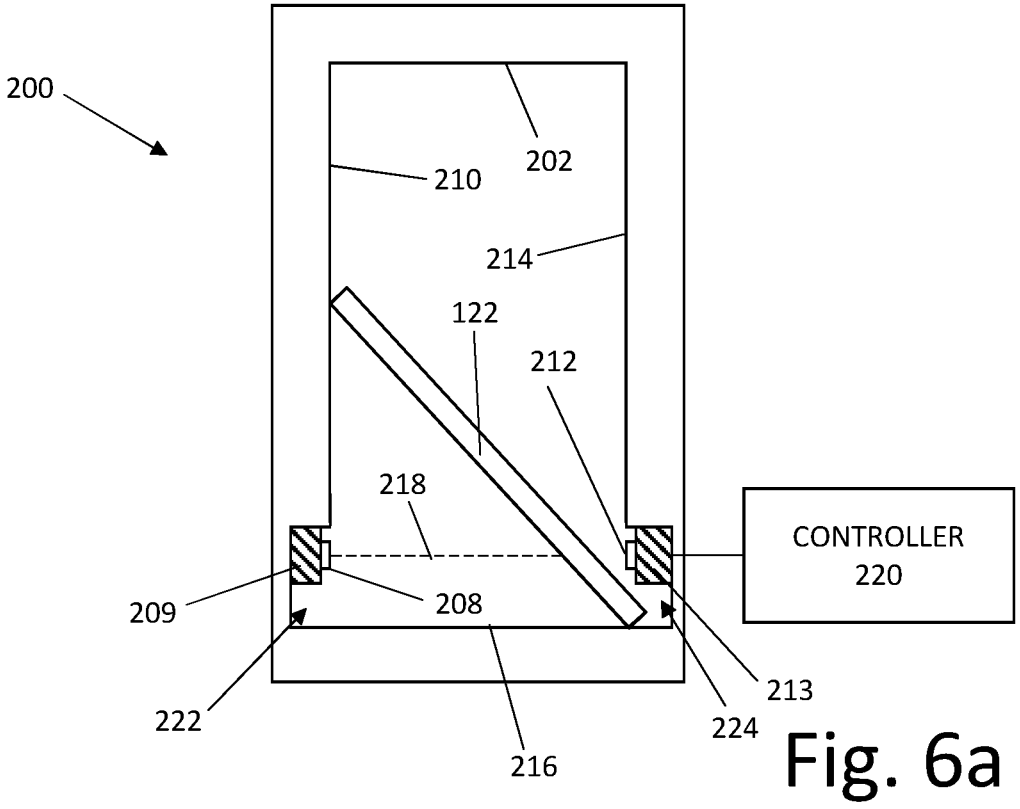
FIG. 6*a* is a cross sectional front view of a vertical smart locker, according to some embodiments of the present invention.

FIG. 6*a* is a cross sectional front view of a vertical smart locker 200, according to some embodiments of the present invention.

The vertical smart locker 200 of the present invention is box-like and has two side walls 210 and 214, a floor 216, a ceiling 202, and a sensing system. The sensing system includes an array of emitters 208 embedded in the first side wall 210, an array of receives 212 embedded in the second side wall 212, and controller 220. The emitters 208 and receivers 212 are aligned with each other, as explained above with reference to FIG. 2, so that electromagnetic waves 218 emitted by the emitters 208 propagate towards the receivers 212 in the absences of a parcel 122 blocking the propagation of the electromagnetic waves. The emitters generate signals indicative of detection of the electromagnetics waves or lack of detection of the electromagnetic waves. The controller 220 receives the signals from the emitters and determines whether a parcel is present in the smart locker 200, depending on how many receivers indicate lack of detection of the electromagnetic waves.

In the locker 200, the horizontal width (i.e. the distance between the side walls 210 and 214) is smaller than the vertical height (i.e., the distance between the floor 216 and the ceiling 202). Also, the size of the locker 200 is chosen such that a flat parcel 122 cannot lie flat on the floor 216. Rather the flat parcel 122 is supported by the floor and one of the walls. In this manner, any flat parcel 122 is assured to block the propagation of the electromagnetic wave 218 to the receivers 212 and there is no risk that the flat parcel 122 remains undetected. In a non-limiting example, the horizontal width of the locker 200 is about 50 mm, while the vertical height of the locker 200 is about 233 mm. Lockers with different sizes are within the scope of the present invention, depending on the size of flat parcels delivered to the lockers. In some embodiments of the present invention, the lockers 200 are configured for storing standard envelopes having a width of 4.5 inches. Thus, the distance between the walls is to less than 4.5 inches, so that the standard envelope cannot lie flat on the floor 216 and blocks the propagation of the electromagnetic waves 218 from the emitters 208 to the receivers 212. If the requirement is to detect flat parcels smaller than the standard envelope, the horizontal width can be selected to be even smaller to prevent the flat parcels from lying flat on the floor of the locker 200.

It should be understood that the thickness of the flat parcel 122 in FIG. 6*a* is shown to be larger than can be detected, for clarity purposes. In the present invention, the flat parcel 122 may have a thickness of a single piece of fine paper, and still be detected to be present in the locker.

The fact that the emitters 208 and receivers 213 are embedded in the first side wall 210 and in the second side wall 214 respectively ensures that the flat parcel 122 does not stand above the propagation axis of the electromagnetic wave 218. Moreover, the emitters 208 and the receivers 213 are placed low one the sidewalls, near the floor 216.

In some embodiments of the present invention, the first side wall 210 has a first recess level with the floor 216 and the second side wall 214 has a second recess level with the floor 216. The recesses are configured for insertion of the emitters 208 and receivers 213 (and optionally of the emitter sheath 209 and the receiver sheath 213, if present), so that the pre-fabricated arrays of emitters and receivers can be easily embedded into their respective side walls, without extending out of the recesses.

In some embodiments of the present invention, the emitters are arranged horizontally and located in the first recess, such that a first empty space 222 is present between the floor and the array of emitters. Similarly, the receivers are arranged horizontally and located in the second recess, such that a second empty space 224 is present between the floor and the array of receivers. The empty spaces allow the storage of larger flat parcels, such that one end of the parcel is inside one of the gaps and the other end of the parcel is supported by the wall opposite the gap.

FIG. 6*a* is a cross sectional top view of a vertical smart locker 200, according to some embodiments of the present invention.

In the smart locker 200, the distance between side walls 210 and 214 is considerably smaller than the distance between side walls of the smart lockers of the prior art. The shorter distance decreases the number of receivers 112 reached by the flood of waves emitted by any emitter 108 if the flat parcel 122 stands at an angle instead of laying on the floor. Therefore, a flat parcel 122 is able to effectively block at least one of the receivers 112 from receiving any electromagnetic waves 118, or to receive a much smaller portion of the waves, that the waves are not detected.

Figure 7:
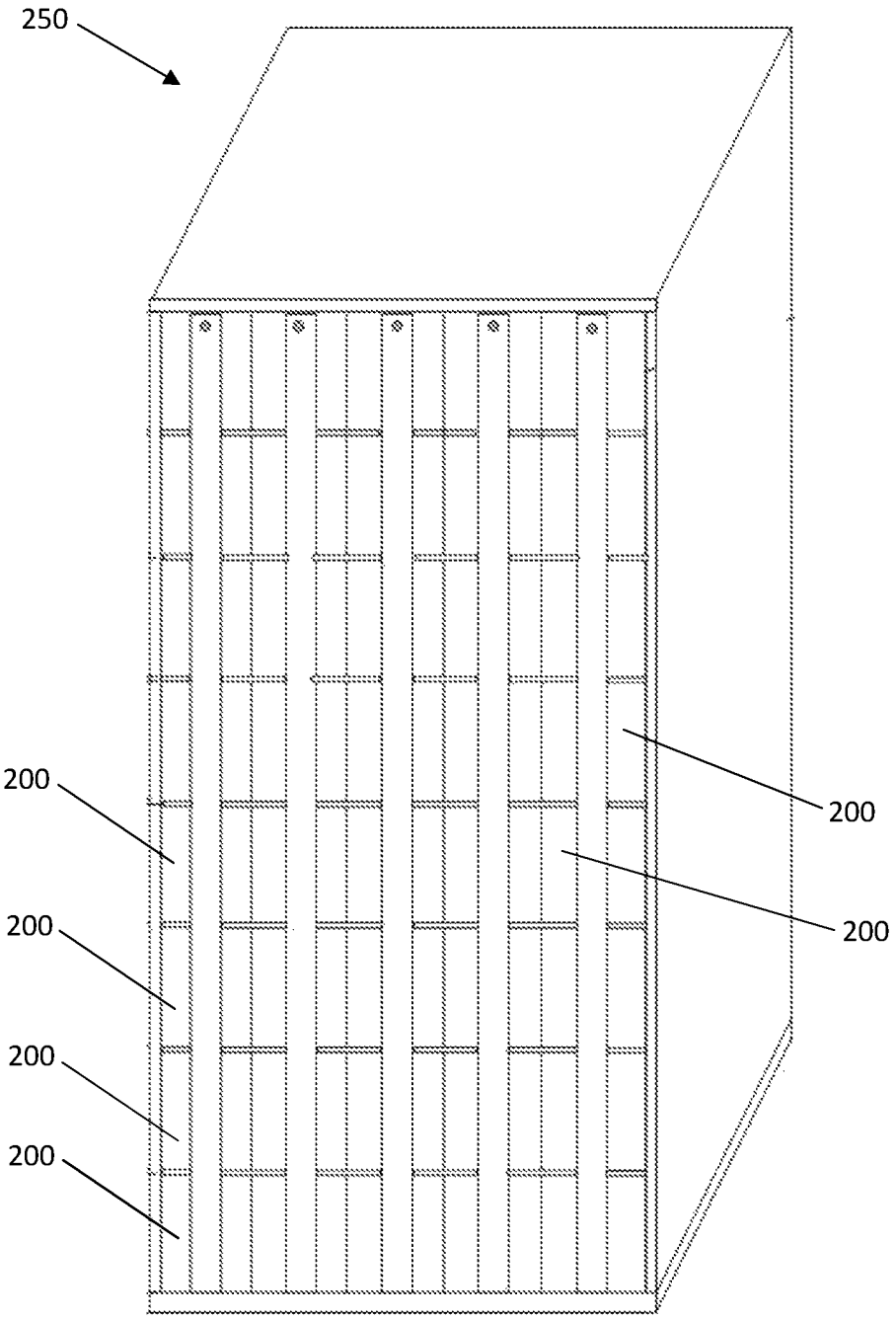
FIG. 7 illustrates a system of vertical smart lockers according to some embodiments of the present invention.

FIG. 7 illustrates a system 250 of vertical smart lockers 200 according to some embodiments of the present invention. The system 250 includes a plurality of smart lockers 200. The system 250 may be designed for delivery of flat parcels or of mass mail.

Figure 8:
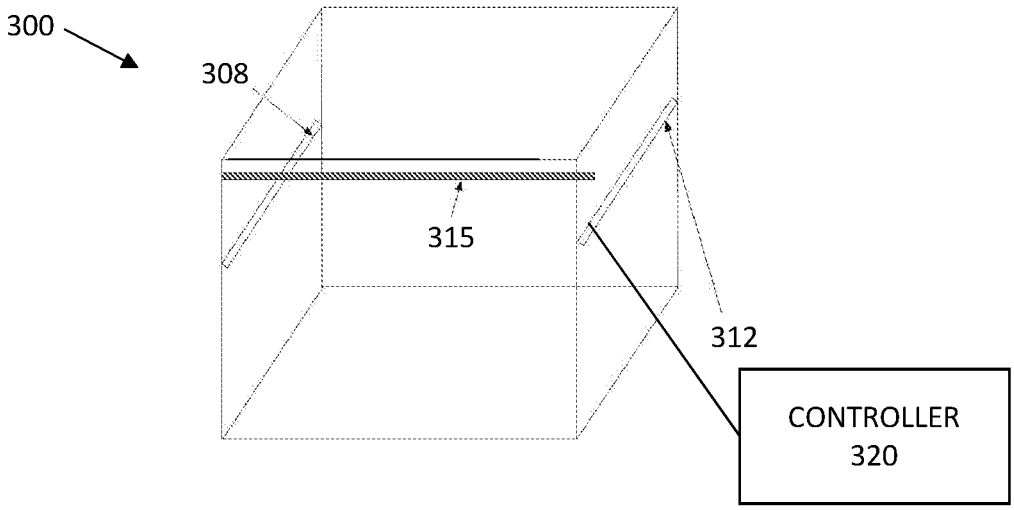
FIG. 8 illustrates a dry cleaning smart locker having emitters and receivers disposed horizontally on respective side walls, according to some embodiments of the present invention.
Figure 9:
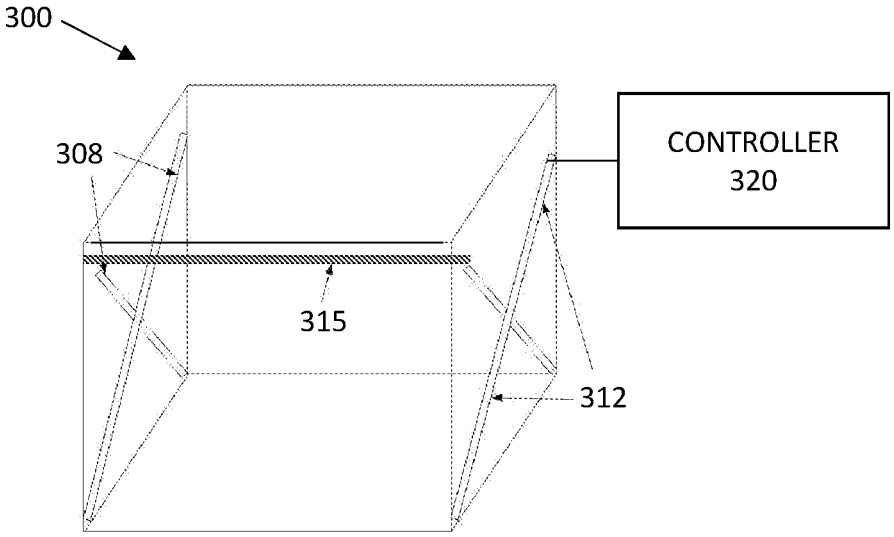
FIG. 9 illustrates a dry cleaning smart locker having emitters and receivers disposed in diagonal cross patterns on respective side walls, according to some embodiments of the present invention.
Figure 10:
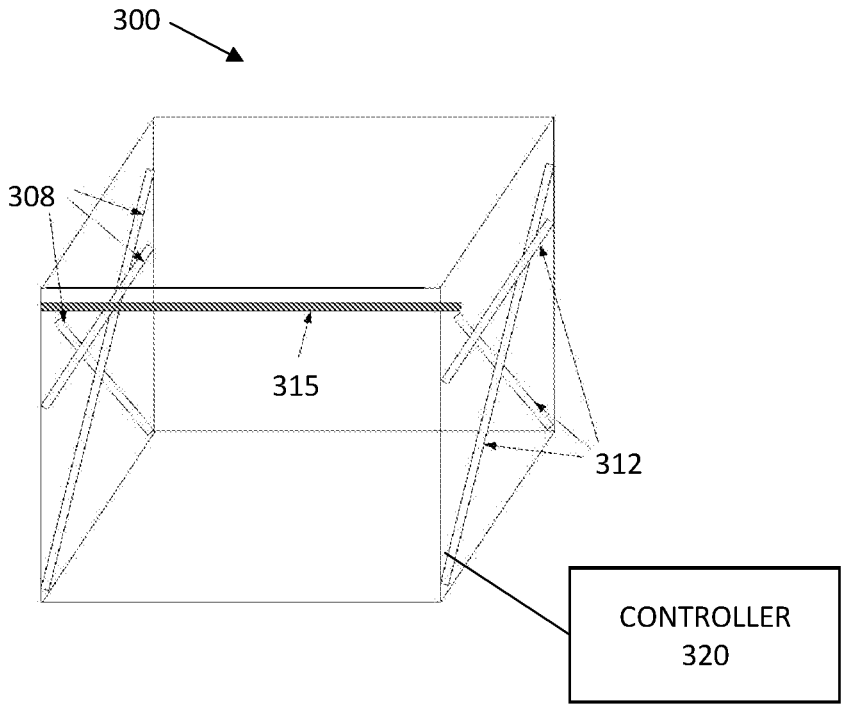
FIG. 10 illustrates a dry cleaning smart locker having emitters and receivers disposed both horizontally and in diagonal cross patterns on respective side walls, according to some embodiments of the present invention.

FIG. 8 illustrates a dry cleaning smart locker 300 having emitters and receivers disposed horizontally on respective side walls, according to some embodiments of the present invention. FIG. 9 illustrates a dry cleaning smart locker 300 having emitters and receivers disposed in diagonal cross patterns on respective side walls, according to some embodiments of the present invention. FIG. 10 illustrates a dry cleaning smart locker 300 having emitters and receivers disposed both horizontally and in diagonal cross patterns on respective side walls, according to some embodiments of the present invention.

The dry cleaning smart locker 300 is similar to the smart locker 200. However, in the dry cleaning smart locker 300 the emitters 308 and the receivers 312 need not be embedded in their respective side walls. Moreover, the emitters 308 and the receivers 312 are located higher up on their respective side walls, below a hanging pole 315 extending horizontally between the side walls. In this manner, an item of clothing hanging on the hanging pole 315 blocks electromagnetic wave propagating from the emitters 308 to the receivers 312. The receivers send signals to the controller 320, indicative of the lack of detection of the electromagnetic wave, and the controller 320 designates the dry cleaning smart locker 300 as full.

The emitters 308 and receivers may 312 be disposed in any desired configurations along the walls. In the example of FIG. 8, the emitters and receivers are disposed. In the example of FIG. 9, the emitters and receivers are disposed diagonally or in a diagonal cross shape as shown. In the example of FIG. 10, the emitters and receivers are disposed both along a diagonal cross shape and horizontally. In some embodiments of the present invention, the horizontal width of the dry cleaning smart locker is 403 mm, while the vertical height of the dry cleaning smart locker is 635 mm. It should be noted that these are only examples, and the any dry cleaning smart locker having any size is within the scope of the present invention.

Figure 11:
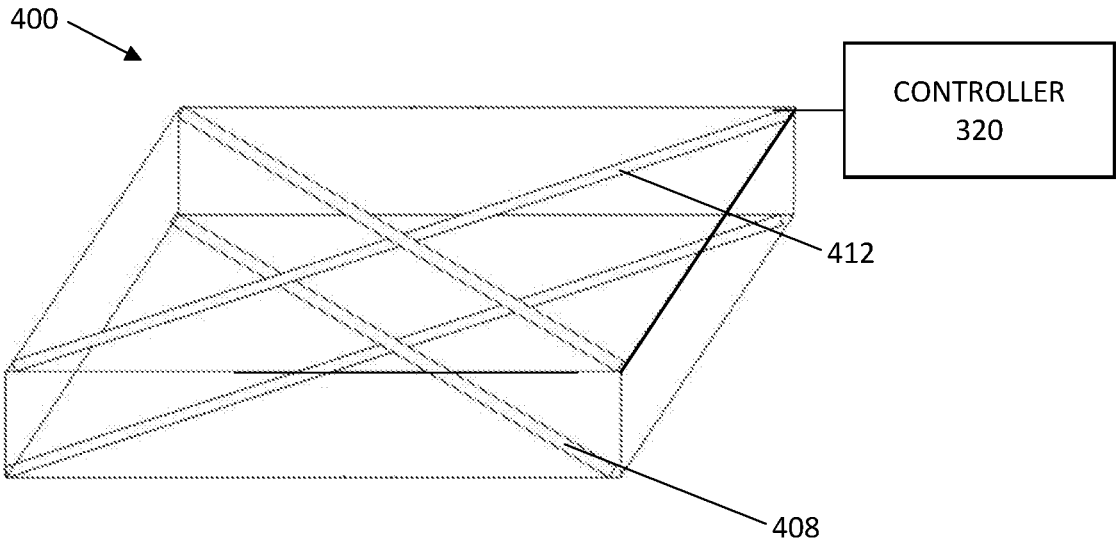
FIG. 11 illustrates a flat smart locker having emitters and receivers disposed on the floor and ceiling of the smart locker in diagonal cross patterns, according to some embodiments of the present invention.

FIG. 11 illustrates a flat smart locker 400 having emitters 408 and receivers 410 disposed on the floor and ceiling of the smart locker in diagonal cross patterns, according to some embodiments of the present invention.

Figure 6B:
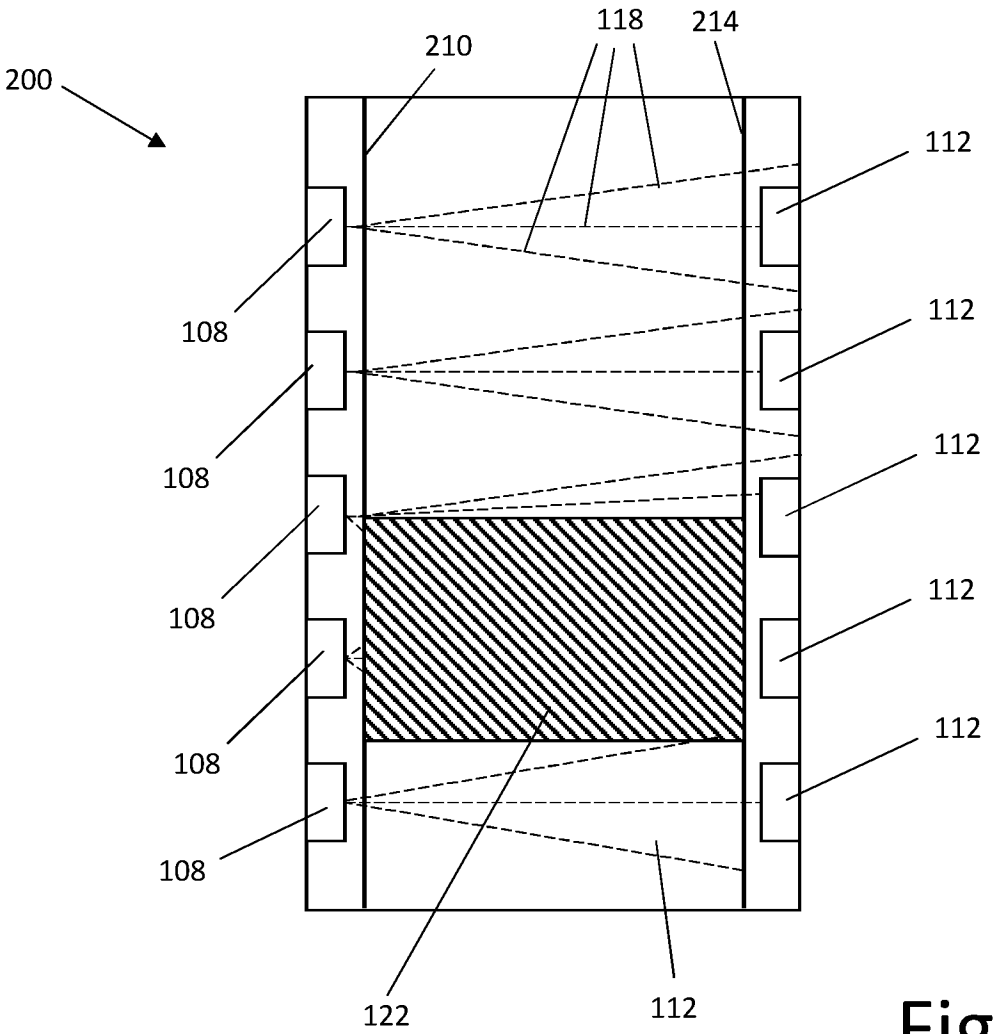
FIG. 6*b* is a cross sectional top view of a vertical smart locker, according to some embodiments of the present invention.

The smart locker 400 is configured for receiving flat parcels. The sensor system of the smart locker 400 operates in a similar fashion to the sensor system of the smart locker 200 of FIG. 6, with the controller 420 determining if a parcel is stored in the locker 400, depending on how many receivers generate signals indicative of the lack of detection of the electromagnetic wave emitted by the emitters.

In the smart locker 400, the emitters 408 may be located on the floor or the ceiling of the smart locker 400. The receivers 412 are located on the floor or ceiling of the smart locker 400, opposite the emitters. Therefore, if the emitters are on the floor, the receivers are on the ceiling. If the emitters are on the ceiling, the receivers are on the floor.

The emitter and receivers may be embedded in the floor and ceiling. In some embodiments of the present invention, the emitters and receivers are arranged along respective diagonal lines. In some embodiments of the present invention, the emitters and receivers are arranged along respective diagonal cross shapes.

Figure 12:
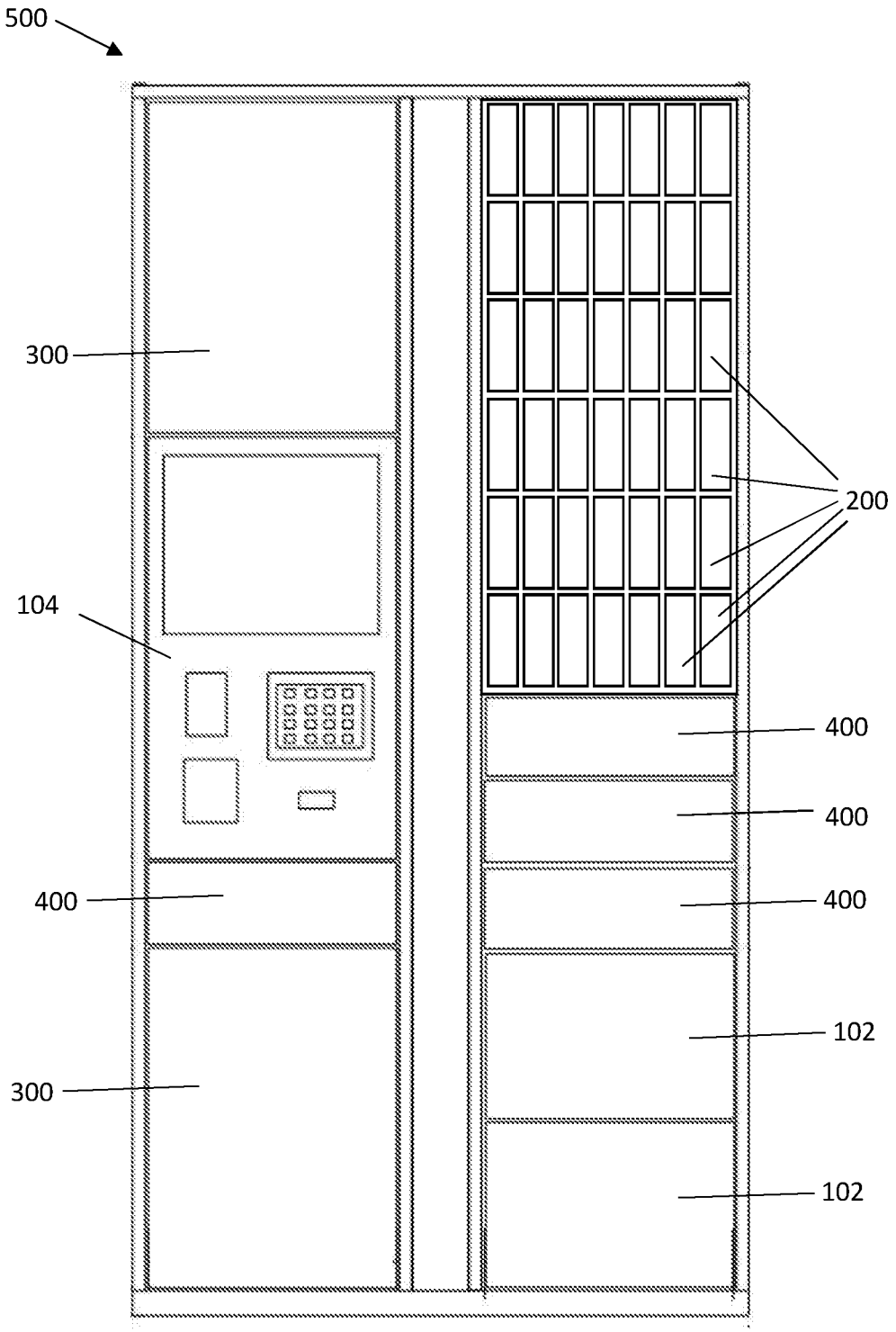
FIG. 12 illustrates a system of lockers divided in groups, according to some embodiments of the present invention.
Figure 13:
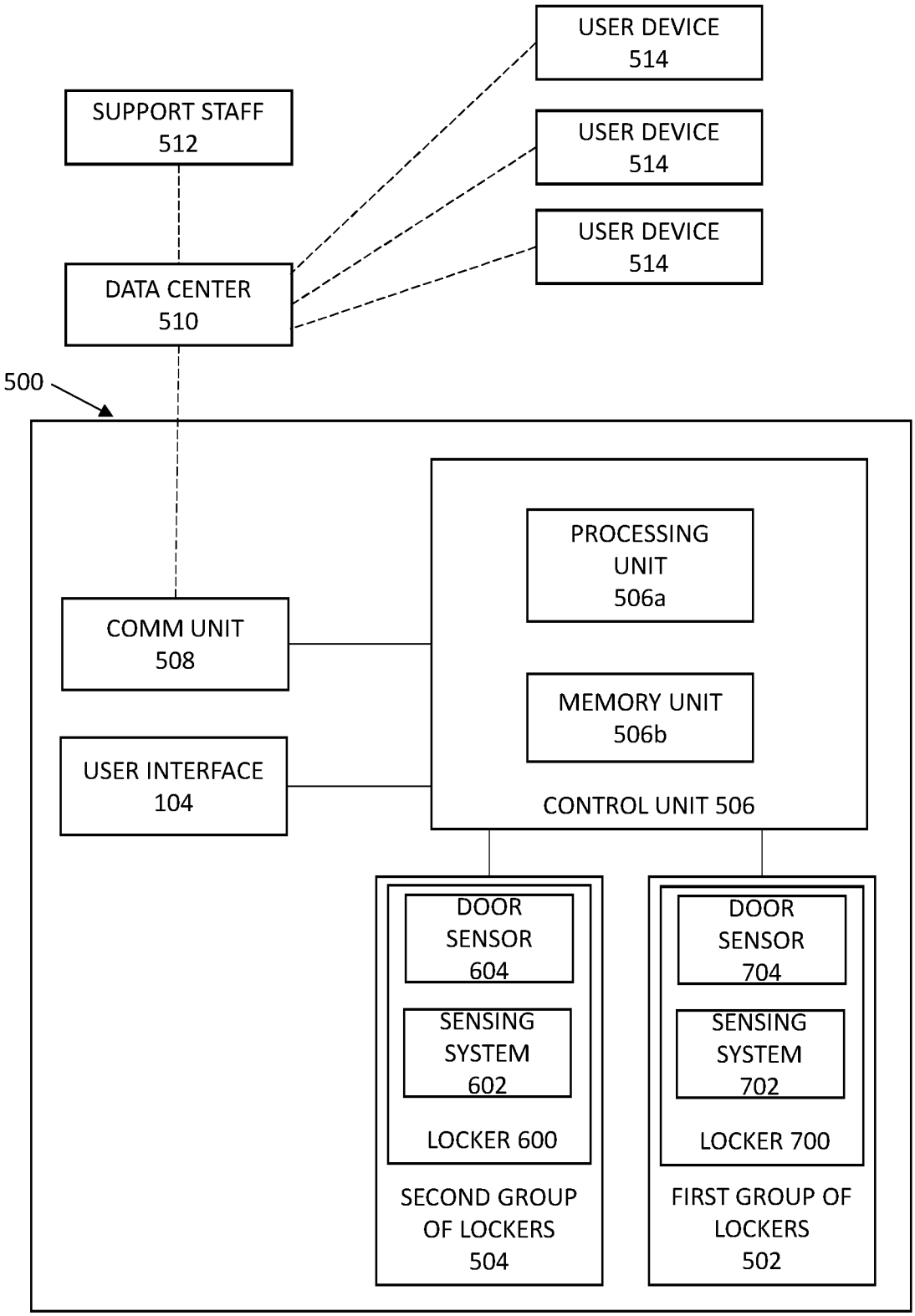
FIG. 13 is a block diagram illustrating different components of the system of FIG. 12.

FIG. 12 illustrates a system 500 of lockers divided in groups, according to some embodiments of the present invention. FIG. 13 is a block diagram illustrating different components of the system of FIG. 12.

The system 500 includes at least two groups of lockers. The first group 502 includes vertical lockers 200 designated for receiving mass mail (generally, flat parcels). The second group 504 is configured for receiving parcels that are not delivered by the postal service. The second group is divided into subgroups designated by the size of the lockers: the first subgroup includes dry cleaning locker 300, the second subgroup includes horizontal lockers 400, the third subgroup includes medium-sized lockers 102. The system 500 also includes a user interface 104 for receiving identification from delivery persons, a control unit 506 in communication with the lockers, and configured for controlling an opening of each locker, a communication unit 508, for communicating input from the user interface to a data center 510. The data center 510 is configured for storing a plurality of identifications of a plurality of delivery persons associated with one or more of the lockers, for comparing the input with the plurality of identifications, and for transmitting to the control unit a command to open one or more of the lockers associated with the identification input by the delivery person. The data center may be a server located proximally to the lockers or remotely from the lockers. In some embodiments of the present invention, a single data center is configured for controlling the operation of a plurality of locker systems 500.

The first group of locker includes lockers 600 (which may be fashioned after locker 200). Each locker 600 has a sensing system 602 for sensing the presence or absence of a parcel inside the locker 600, and a door sensor 604 configured for sensing whether the locker's door is open or closed. Similarly, the second group of locker includes lockers 700 (which may be fashioned after locker 102, 200, 300, or 400). Each locker 700 has a sensing system 702 for sensing the presence or absence of a parcel inside the locker 700, and a door sensor 704 configured for sensing whether the locker's door is open or closed. The control unit 506 is configured for receiving data from the door sensors 604 and 704 and the sensing system 602 and 702, to determine the status of the lockers.

Figure 14:
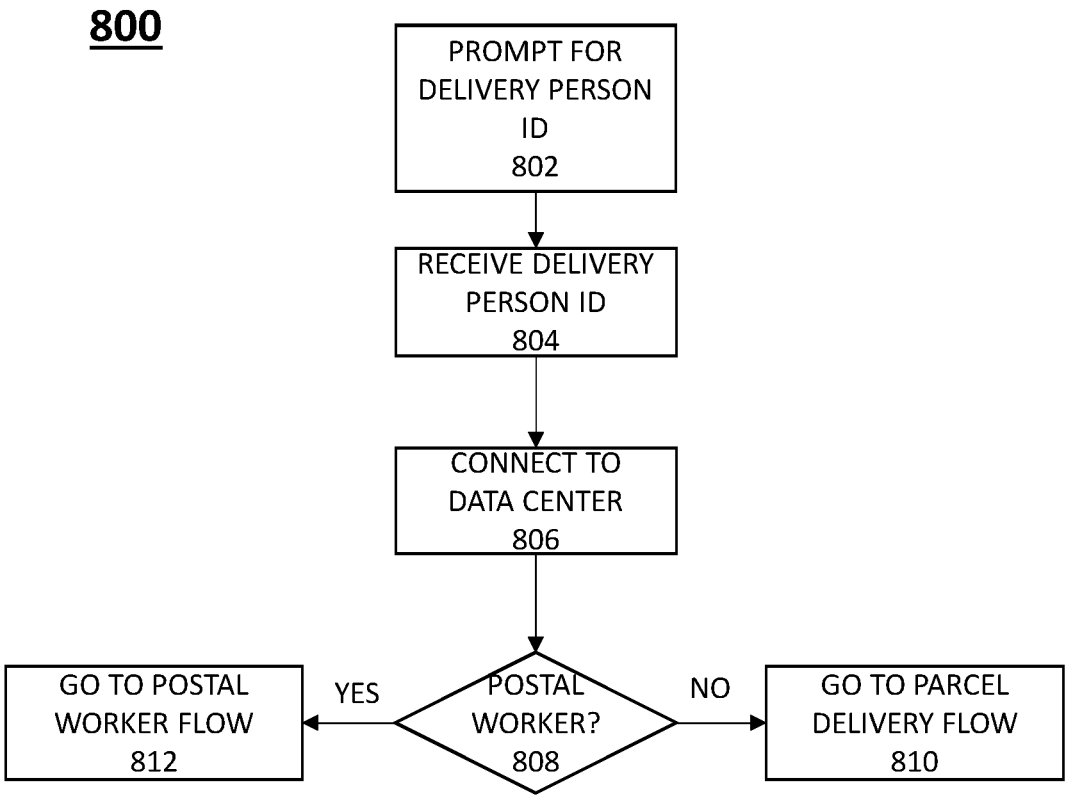
FIG. 14 is a flowchart illustrating a method for managing a system of lockers, according to some embodiments of the present invention.
Figure 15:
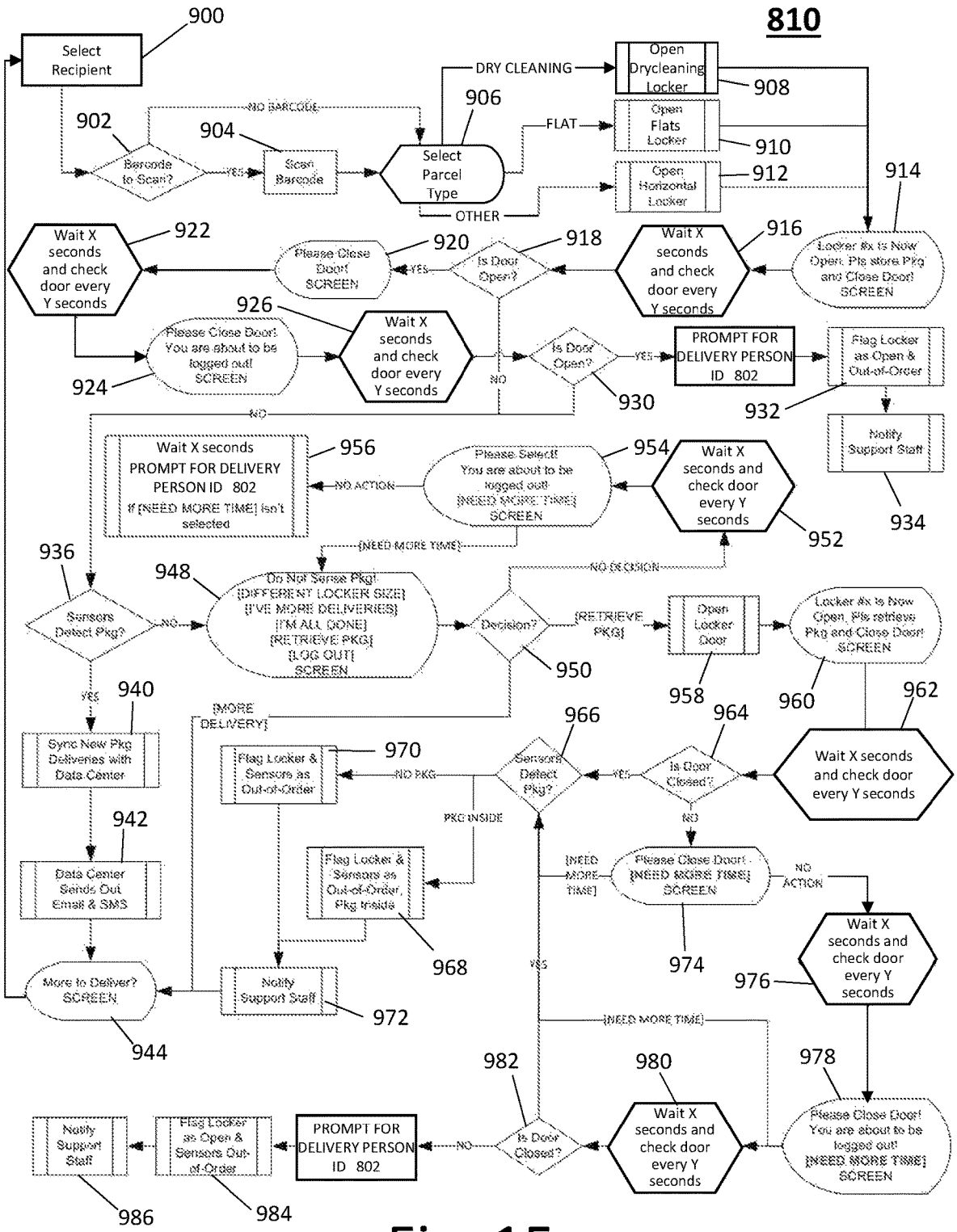
FIG. 15 is a flowchart illustrating a first branch of the method of FIG. 14, in which a delivery is not a delivery by the postal service.
Figure 16:
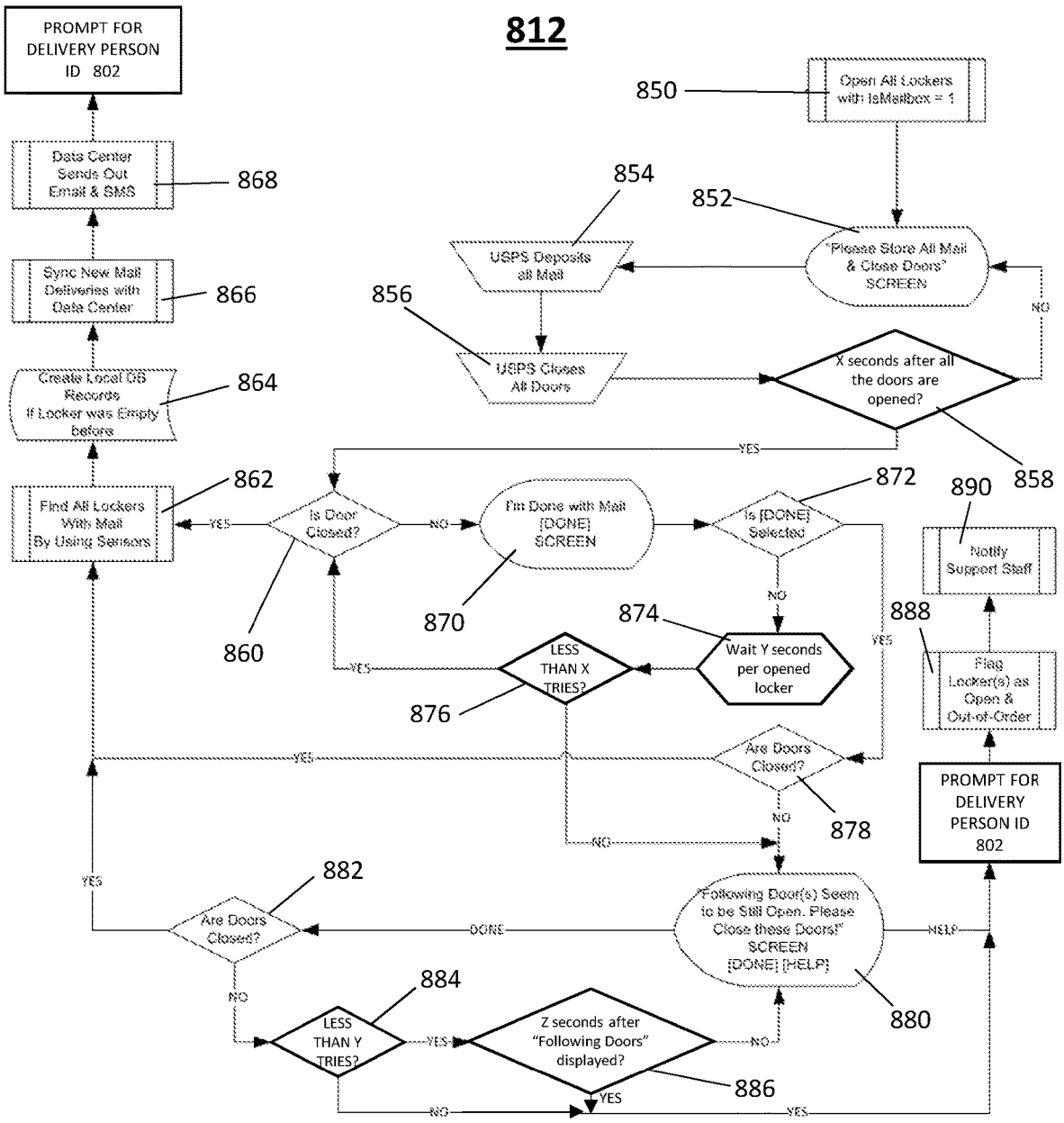
FIG. 16 is a flowchart illustrating a second branch of the method of FIG. 14, in which a delivery is a delivery by the postal service.

The control unit also controls the operation of the user interface 104, as will be seen in the description of FIGS. 14-16. For controlling the operation of the user interface, communicating with the lockers, and communicating with the data center 510, the control unit 506 has a processing unit **506*a* configured for performing such operations according to instructions stored in a non-volatile memory 506*b*. The processing unit 506*a* may also record data on the memory unit 506*b*, as will be described below with reference to FIGS. 14-16**.

The data center 510 is configured for contacting support staff 512, if a locker is deemed out of order by the control unit 506. The data center is configured for contacting recipients via recipient user devices 514 (also referred to as communication devices in this document), to inform the recipients that a package, a parcel, or mail is waiting to be picked up in one or more lockers.

FIG. 14 is a flowchart illustrating a method 800 for managing the system of lockers 500, according to some embodiments of the present invention. FIG. 15 is a flowchart illustrating a first branch 810 of the method of FIG. 14, in which a delivery is not a delivery by the postal service. FIG. 16 is a flowchart illustrating a second branch 812 of the method of FIG. 14, in which a delivery is a delivery by the postal service.

At 802, the user interface prompts the delivery person for an identification. At 804, the delivery person's identification is received by the user interface. At 806, the system connects to the data center, where the identification is compared with identifications stored in the data center. At 808, the data center checks whether the identification belongs to a postal worker or a non-postal delivery person.

If the identification belongs to a non-postal delivery person, the data center communicates this fact to the system 500 and, the first branch 810 is followed.

In the first branch 810, the user interface prompts the delivery person to select a recipient at 900. If there is a barcode to scan on the parcel which is associated with the recipient, the barcode is scanned at 904. Otherwise, the delivery person manually enters the recipient data manually.

At 906, the delivery person is prompted to select the parcel type. If the parcel is a dry cleaning parcel, a dry cleaning locker (such as the dry cleaning locker 300) as described above is opened at 908 by the control unit. If the parcel if a flat parcel, a flats locker (such as the lockers 200 or 400) described above is opened at 910 by the control unit. If the parcel is any other type of parcel (i.e., neither a flat parcel nor a dry cleaning parcel), a regular horizontal locker is opened at 912 by the control unit.

At 914, a message is displayed on the user interface, indicating the locker that has been opened and requesting that the package be stored and the locker's door be closed. At 916, the control unit waits a certain time period (e.g., 30 seconds) and checks whether the door has been closed at predetermined intervals (e.g. 2 seconds) within the time period at 918.

If the door is still open at the end of the period, the user interface displays a message asking the user to close the door at 920. At 922, the control unit waits a certain time period (e.g., 30 seconds) and checks whether the door has been closed at predetermined intervals (e.g. 2 seconds) within the time period. At 924, another message asks that the door be closed and warns the user that he/she is about to be logged out. At 926, the control unit waits a certain time period (e.g., 30 seconds) and checks whether the door has been closed at predetermined intervals (e.g. 2 seconds) within the time period. If door is still open at 930, the user is logged out, and the flow returns to step 802 of the flowchart 800 of FIG. 14. At 932, the control unit flags the locker as open and out of order and sends a message to the data center about this fact. At 934, the data center notifies support staff to check the flagged locker.

If the locker is closed at the checks 918 or 930 or at any time therebetween, a check is made at 936 by the control unit to determine whether the sensing system in the locker detects the parcel/package. If this is the case, the control unit sends the data center a confirmation that the package is stored in the locker at 940. At 942, the data center sends messages to one or more communication devices of the recipient of the package. At 944, the user interface asks the user is he/she has more deliveries to make. If this is the case, the flow returns to step 900. If not, the flow returns to the step 802.

If the sensors do not sense the package at 936, the user interface presents the user with the following choices at 948: choose a different locker size, make more deliveries, done delivering, retrieve package, and log out. At 950, the system checks for the user's selection. The sensing system may fail to sense the package/parcel because the parcel was placed in the wrong type of locker or because the sensing system in the particular locker does not work.

If no selection is made, the control unit waits for a certain time period while checking for a selection at predetermined intervals within the time period. If no selection is made at the end of the time period, the user interface displays a message urging the user to make a selection and prompts the user to enter an input indicative of the fact the user needs more time. This screen stays on for a predetermined time period, as seen in step 956. If the user does not select the "need more time" option within the time period, the flow returns to step 802 of FIG. 14. If the "need more time" option is selected, the flow return to step 948.

If the decision at 950 is to make more deliveries, the flow returns to step 944. If the decision at 950 is to retrieve the package, the locker door is opened at 958 by the control unit. The user interface displays a message to instruct the user to retrieve the package and close the door at 960. At 962 the control unit waits a certain time period, while checking at a predetermined time interval within the time period if the door has been closed at 964.

If the door is closed, the control unit checks if the sensing system detects a package inside. If the package is still inside, the locker and sensing systems are flagged out of order and a note is made that the package is in the locker at 968. Then, support staff is notified at 972 by the data center, and the flow returns to step 944. If the package is not inside, the locker and sensing system is flagged out of order, and steps 972 and 944 are performed.

If the door is still open at 964, the user interface displays a screen requesting the user to close the door, and present the user an option to inform the system that the user need more time at 974. If the "need more time" option is selected, the flow proceeds to step 966. If no action is taken at 974, the control unit waits a certain time period, while checking at a predetermined time interval whether the door has been closed at 976. At 978, if the door is still open, the user is warned that he/she is about to be logged out and presented with a "need more time" option. If the user needs more time, the flow proceed to the step 966. If no action is taken, the control unit waits again at 980. If the door is closed at 982, the system proceeds to steps 966. If the door is still open at 982, the flow returns to step 802 of FIG. 14. The locker is flagged as opened with sensors out of order at 984 by the control unit. At 986, the data center notifies support staff about the condition of the flagged locker.

If the check 808 of FIG. 14 identifies the delivery person as a postal worker, the second branch 812 is followed.

At 850, all the lockers designated for mass mail delivery are opened by the control unit, allowing the postal worker to quickly deliver to all the opened lockers. At 852 the user interface requests that mail be stored and locker doors be closed.

At 854, the postal worker deposits the mail in the desired lockers. At 856, the postal worker closes all doors. At 858 a check is made to determine whether a certain time interval (e.g., 15 seconds) has passed since all doors have been opened. If the time interval has not passed, the flow returns to step 852. If the time interval has passed, a check is made at 850 to check if the doors have been closed.

If all doors have been closed, the control unit identified all the lockers which have mail at 862. At 864, the control unit uses a local database to check whether the lockers with mail were empty when checked the last time, and identifies the lockers having new mail. At 866, the list of lockers with new mail is delivered to the data center. At 868, the data center messages on or more communication devices of the users associated with the lockers having new mail. The flow then returns to step 802.

If not all doors are closed at 860, the user interface displays a screen requesting the postal worker to confirm that he/she is one with mail deliveries at 870. If the postal worker does not take any action at 872, the control into waits a certain time interval for each opened locker at 874. At 876, a check is made to determine whether the steps 860, 870, 872 and 874 have been performed less than a certain number of times (e.g., twice). If this is the case, the flow returns to step 860. If this is not the case, at 880 the user interface displays a screen identifying the lockers with open doors, and allows the user to select two options: "done" and "help".

If "done" is selected at 880, a check is made to determine if all the doors are closed at 882. If the doors are closed, the flow proceeds to step 862. Otherwise, a check is made at 884 to determined whether the steps 880 and 882 have been performed less than a certain number of times (e.g. twice). If this is the case, a check is made at 886 to check if a certain time period has passed after the message at 880 was first displayed. If the time period has not passed, the flow returns to step 880. If the time period has passed, the flow returns to step 802, the lockers sensed open are flagged as open and out of order at 888, and support staff is notified at 890.

If the user chooses "help" at 880, the steps 888 and 890 are followed, and the flow returns to 802. If the check at 884 determines that the steps 880 and 882 has been performed more than a certain number of times, the steps 888 and 890 are followed, and the flow returns to 802. If "done" is selected at 872, the flow proceeds to step 878.

The invention is not to be understood as limited to the details of construction and relative arrangements and proportions of parts of the preferred embodiment thereof shown and described, as modifications thereof may obviously be made by those skilled in the art within the spirit and scope of the invention.

What is claimed is:

1. A locker for storage of a parcel, the locker comprising:

i) a first and second side wall, each having the vertical height and a horizontal depth;

ii) a front side with a vertical height and horizontal width, the vertical height being larger than the horizonal width, the horizontal width being less than three inches, for ensuring that a flat parcel inserted into the locker does not lie flat on a floor of the locker and is supported by at least one of the first and second walls;

iii) a door configured for being opened to allow outside access to an inner volume of the locker and for being closed to deny outside access to the inner volume of the locker;

iv) a sensor system comprising:

an array of emitters located at the first side wall and facing the second side wall, each emitter being located at a distance of no more than five centimeters from a nearest emitter thereof and being configured for emitting a respective electromagnetic wave, wherein the emitters are disposed to form a first line at a bottom of the first side wall, along the horizontal depth of the first side wall, starting at a front of the first side wall and ending at a back end of the first side wall;

an array of receivers located at the second side wall and facing the first side wall, each receiver being configured for detecting the electromagnetic waves from one or more of the emitters, each receiver being located at a distance of no more than five centimeters from a nearest receiver thereof and being configured for generating first signals indicative of detection and lack of detection of the electromagnetic waves, wherein the receivers are disposed to form a second line at a bottom of the second side wall, along the horizontal depth of the second side wall, starting at a front of the second side wall and ending at a back end of the second side wall;

a door sensor, configured to sense whether the door is open or closed and to generate second signals indicative of the door being open and the door being closed;

a controller configured for receiving the second signals from the door sensor and first signals from the emitters and processing the first signals to determine a presence or absence of the parcel in the locker every time and only when the door has been opened and closed;

wherein the parcel located in the locker blocks a propagation of at least some of the electromagnetic waves toward the emitters;

wherein the emitters are embedded in the first side wall and the receivers are embedded in the second side wall, such that the emitters and the receivers do not protrude out of the first side wall toward the second side wall and the receivers do not protrude out of the second side wall toward the first side wall.

2. The locker of claim 1, wherein:

the first and second walls have respectively first and second recesses, the recesses being level with a floor of the locker and parallel to a floor of the locker;

the emitters are arranged horizontally and located in the first recess;

the receivers are arranged horizontally and located in the second recess.

3. The locker of claim 1 wherein the emitters are arranged horizontally on the first wall and the receivers are arranged horizontally on the second wall.

4. The locker of claim 1, wherein the emitters are arranged diagonally on the first wall and the receivers are arranged diagonally on the second wall.

* * * * *